US006503344B2

(12) United States Patent
Baudis et al.

(10) Patent No.: US 6,503,344 B2
(45) Date of Patent: Jan. 7, 2003

(54) BORONIZING AGENT IN PASTE FORM

(75) Inventors: Ulrich Baudis, Alzenau (DE); Stefan Wigger, Hanau (DE)

(73) Assignee: Houghton Durferrit GmbH, Mannheim (DE)

( * ) Notice: Subject to any disclaimer, the term of this patent is extended or adjusted under 35 U.S.C. 154(b) by 0 days.

(21) Appl. No.: 09/960,646

(22) Filed: Sep. 24, 2001

(65) Prior Publication Data

US 2002/0036030 A1 Mar. 28, 2002

Related U.S. Application Data

(63) Continuation-in-part of application No. 09/495,361, filed on Feb. 1, 2000, now abandoned.

(30) Foreign Application Priority Data

Feb. 5, 1999 (DE) ..... 199 04 629

(51) Int. Cl.[7] ..... C23C 8/00

(52) U.S. Cl. ..... 148/279; 148/280; 148/217; 148/283; 252/385

(58) Field of Search ..... 252/385; 148/280, 148/279, 217, 283

(56) References Cited

U.S. PATENT DOCUMENTS

| | | | | |
|---|---|---|---|---|
| 3,770,512 | A | 11/1973 | Bopp | 148/6 |
| 3,881,039 | A | 4/1975 | Baldieri et al. | 427/294 |

FOREIGN PATENT DOCUMENTS

| | | |
|---|---|---|
| CH | 556394 | 11/1974 |
| DE | 140676 | 3/1980 |
| EP | 016761 | 11/1985 |
| FR | 2153416 | 5/1973 |
| GB | 1258372 | 12/1971 |

OTHER PUBLICATIONS

Chemical Abstracts, vol. 101, No. 6, Aug. 6, 1984 Wu et al., "Pack Boriding and Control of the Carbon content in the Transition Layers", XP 002145323, Feb. 7, 1984.

Patent Abstracts of Japan C–910, Feb. 17, 1992, vol. 16, No. 61, 3–257151, Nov. 15, 1991, "Surface Hardening Treatment of Titanium Material and Cemented Carbide By Paste Method".

Journal of the Less–Common Metals, 67 (1979), pp. 339–345, "The Solid Boriding of Permalloy for Magentic Head Application", Kawabata et al., (no month data).

"Beobachtungen beim Oberflächenborieren von Stahl", 1967, Härterei–Technik, pp. 275–292. Kunst et al, (no month data).

*Primary Examiner*—John Sheehan
*Assistant Examiner*—Andrew L. Oltmans
(74) *Attorney, Agent, or Firm*—Smith, Gambrell & Russell, LLP

(57) ABSTRACT

A boronizing agent in the form of a paste for the production of boride layers on metallic workpieces. The boronizing agent contains boron-releasing substances, activating substances and the remainder of inert, refractory extenders together with water and optionally auxiliaries required for paste formulation. It contains as additives:

(a) calcium carbonate and/or lithium carbonate;

(b) at least one compound from the group of alkali metal and alkaline earth metal nitrites;

(c) at least one compound from the group of water soluble alkali metal and alkaline earth metal borates.

16 Claims, No Drawings

BORONIZING AGENT IN PASTE FORM

The present application is a continuation-in-part of Ser. No. 09/495,361, filed Feb. 1, 2000 now abandoned which prior application is incorporated herein by reference.

INTRODUCTION AND BACKGROUND

The present invention relates to a boronizing agent in the form of a paste for the production of boride layers on metallic work pieces and materials. The purpose of this paste is, in particular, to produce single-phase, hard and tenacious boride layers on ferrous materials in order to increase wear resistance and in order to improve the corrosion resistance of such workpieces.

Boronizing has long been known as a process for protecting iron, steel and refractory metals from wear. Dense, uniform layers of particular borides, for example the borides FeB, $Fe_2B$ on iron, are produced by elemental boron diffusing into the surface of the workpiece being treated and reacting with the base material. In comparison with the pure metals, the borides have considerably modified properties, in particular most borides are very hard, corrosion-resistant and thus extremely wear-resistant. Since they are produced by diffusion and a solid-state reaction, the boride layers are solidly bonded to the base material. With regard to wear resistance, some boronized steels are, for example, superior to steels treated by nitriding or carburizing.

Numerous means and industrial processing variants have accordingly been developed in the past by means of which boride layers may be produced, in particular on steel.

In practice, boronizing is predominantly performed in solid Boronizing agents. In this case, the parts to be treated are packed in iron boxes in powder mixtures which substantially consist of boron-releasing substances, activating substances with the remainder being inert, refractory extenders. The sealed boxes are heat treated for a certain period, wherein the desired boride layers are formed on the parts in a direct solid-state reaction or by transport of the boron in the gas phase. This is well known in the art.

Boronizing is conventionally performed at temperatures of between 800 and 1100° C. and in particular between 850 and 950° C. Achievable layer thicknesses of the boride layers are normally in the range between 30 and 300 $\mu$m.

Boron-releasing substances which may be considered for use as boronizing agents are amorphous and crystalline boron, ferroboron, boron carbide and borates such as borax. Suitable activating substances are chloride or fluoridereleasing compounds such as alkali metal and alkaline earth metal chlorides or fluorides. Fluoroborates, such as in particular potassium tetrafluoroborate, are particularly widely used as activators. Typical extenders are aluminum oxide, silicon dioxide and silicon carbide. Boronizing agents of this type are described, for example, in German Patent 17 96 212. A typical composition which has hitherto proved successful as a boronizing agent contains approx. 5 wt. % of boron carbide, 5 wt. % of potassium tetrafluoroborate and 90 wt. % of silicon carbide. Boronizing agents of the stated type are normally used as powder mixtures. They may, however, also be formulated as pellets (for example DE-OS 21 27 096) or as pastes (for example DE-OS 26 33 137). In the case of pellets and pastes, the compositions also contain subordinate quantities of binders and water respectively.

Processes have furthermore been developed which operate with gaseous boronizing agents such as diborane, boron halides or, alternatively, in molten salt baths with boron carbide and borax as the boron-releasing substances. These latter-stated processes have not become well established due to the toxicity of the compounds and due to processing disadvantages, such as the elaborate control measures required to ensure a uniform boronizing action. Recent attempts to produce boride layers using plasma processes are not suitable for all applications due to the influences of charging and complex geometric shapes. Plant and equipment costs are moreover very high. Solid boronizing agents, some of which are also used in paste form, thus still retain their dominant position for surface boronizing since they have the advantages of being simple to use and providing good boride layers.

The most common boronizing processes using known solid boronizing agents do, however, have the disadvantage that they demand highly elaborate processing technology in order to produce single-phase iron boride layers in particular on ferrous materials (c.f. for example EP 0 387 536 B1).

Since the two borides $Fe_2B$ and FeB have differing properties and multi-phase layers usually have poorer properties than single-phase layers, efforts are made to produce single-phase layers when boronizing.

Thus, in particular, the FeB phase, which has a higher boron content, is substantially more brittle than the $Fe_2B$ phase, which has a negative influence on the wear resistance of the boronized components. In boride layers thicker than 50 $\mu$m, an FeB case is also readily formed, which should, if at all possible, be avoided for the stated reason.

Using hitherto known boronizing pastes, it has previously been possible under conventional processing conditions to obtain single-phase layers only of a thickness of less than 50 $\mu$m. If thicker boride layers are to be obtained, it is necessary to perform post-diffusion by a complex heat treatment operation under a vacuum or in a salt bath or special boronizing agents are required (for example according to German patent application 198 30 654.7). Moreover, fluoride emissions are found in the exhaust gases from conventional boronizing pastes. Both post-diffusion and fluoride emissions result in layer porosity, which has a negative impact on layer properties.

With many materials, known boronizing pastes result in corrosive attack on the coated workpiece during the drying phase. As a result, paste residues adhere so strongly to the surface of the workpiece after treatment that cleaning the components with water is not sufficient and an additional jet cleaning operation is required, wherein there is also a risk that the boride layer which has been produced will also be affected. Such corrosive attack may be so severe that it has not previously been possible to use paste boronizing on certain grades of steel as it results in corrosive loss of material.

Known boronizing pastes are not stable in storage, in particular at elevated temperatures, due to dissociation of the activator $KBF_4$ accompanied by a reduction in pH.

An object of the invention is accordingly to provide a boronizing agent in the form of paste with which, in particular on ferrous materials, produces a virtually exclusively single-phase boride layer containing $Fe_2B$.

Moreover, another object is also to reduce the content of water-soluble fluorides in these boronizing agents in paste form and that correct use should be accompanied by reduced fluoride emissions.

A further object is also to reduce the porosity of the boride layer formed.

Still further, it is an object to prevent corrosive attack and thus also facilitate cleaning of the components as well as to improve the storage stability of the boronizing paste.

SUMMARY OF THE INVENTION

It has surprisingly now been found that, in boronizing agents in paste form which include boron-releasing substances, activating substances and the remainder of inert, refractory extenders together with water and optionally auxiliaries required for paste formulation, these disadvantages may be overcome by the addition of small quantities of certain additives.

It has firstly been discovered that the porosity of the boride layer may be distinctly reduced by the addition of calcium carbonate and/or lithium carbonate, for example calcium carbonate. This brings about extended component service life. Hydrogen fluoride emissions are additionally reduced by fluorides, for example HF, being bound as $CaF_2$. The optionally produced $CaF_2$ moreover brings about the positive effects described in German patent application 198 30 654.7.

It has moreover been discovered that corrosive attack by the boronizing paste on all investigated grades of steel may be completely suppressed by the addition of alkali metal or alkaline earth metal nitrites, for example sodium nitrite. As a result, not only may higher surface qualities be achieved, but it is also possible to treat steels which could not hitherto be paste boronized. In contrast, testing with other known corrosion-protective agents did not meet with success; indeed, more severe corrosion sometimes occurred than in the absence of conventional corrosion protective additives.

It has furthermore been discovered that an improvement in storage stability of the boronizing paste may be achieved by the addition of water-soluble alkali metal or alkaline earth borates, for example sodium tetraborate (borax). The inevitable dissociation of the activator $KBF_4$ in water results in the formation of HF and thus in acidification of the paste with increased corrosive attack and possible instability of paste auxiliaries, such as the thickener. This is completely suppressed by the addition of borate. The storage stability of the boronizing paste is consequently substantially extended. Attempts to prevent a reduction in the pH value solely by addition of soluble carbonates, such as for example sodium carbonate, modified the viscosity and Theological properties of the paste, so having a negative impact on the use thereof.

It has furthermore been found that cleaning of the components and the surface appearance may be improved by addition of borate, as it forms a very thin, glaze-like film on the component, so facilitating removal of the paste after boronizing. In addition to the corrosion protection described above, it is consequently also possible to avoid jet cleaning of the components after boronizing.

The invention accordingly provides a boronizing agent in the form of a paste for the production of boride layers on metallic workpieces, which boronizing agent contains an essential components boron-releasing substances, activating substances and the remainder of inert, refractory extenders together with water. Optionally, auxiliaries required for paste formulation can be inlcuded. The paste of this invention is characterised in that it contains as additives (a) calcium carbonate and/or lithium carbonate;

(b) at least one compound selected from the group consisting of alkali metal and alkaline earth metal nitrites;

(c) at least one compound selected from the group consisting of water-soluble alkali metal and alkaline earth metal borates.

The boronizing paste according to the invention preferably contains, relative to the solids content, 0.1–5 wt. % of calcium carbonate and/or lithium carbonate, 0.1–2 wt. % of compounds according to (b) and 0.1–2 wt. % of compounds according to (c).

The boronizing paste in particular contains, relative to the solids content, 1–3 wt. % of calcium carbonate and/or lithium carbonate, 0.2–1 wt. % of compounds according to (b) and 0.2–1 wt. % of compounds according to (c).

Calcium carbonate and lithium carbonate are particularly preferred because of the low water solubility of their corresponding fluorides.

Alkali metal nitrites, such as in particular sodium and potassium nitrite, are preferably considered as compounds according to (b). Sodium nitrite is particularly preferred.

Alkali metal borates, such as in particular sodium and potassium borate, are examples from the group of compounds according to (c). Sodium tetraborate (borax) is particularly preferred.

The boronizing paste according to the invention preferably contains boron carbide as the boron-releasing substance, potassium tetrafluoroborate as the activating substance and silicon carbide as the extender.

In a particularly preferred embodiment, the boronizing paste contains a combination of potassium tetrafluoroborate and calcium fluoride as the activating substance.

It has, in fact, furthermore been found that the type of boride formation in the workpiece surface may purposefully be influenced and controlled by a boronizing agent of a per se conventional composition, to which, in addition to conventional activator substances, calcium fluoride is added as a further activating substance. In this manner, it is straightforwardly possible, without any other elaborate processing measures, to produce virtually FeB free, single-phase $Fe_2B$ layers on workpieces made from ferrous materials.

Further investigation has revealed that when $KBF_4$ is completely replaced by $CaF_2$ in conventional prior art boronizing agents, inadequate boride layers are formed on the surfaces of the workpiece under normal processing conditions. The same happens if, in order to reduce fluorine emissions, the content of $KBF_4$ in the boronizing agent is simply reduced.

The boronizing paste according to the invention conveniently contains as activating substance a combination of 1 to 15 wt. % of potassium tetrafluoroborate and 5 to 40 wt. % of calcium fluoride, in each case relative to the solids content.

The boronizing agent in paste form according to the invention may contain conventional boron-releasing substances, such as amorphous or crystalline ferroboron and in particular boron carbide ($B_4C$). It preferably contains 1 to 15 wt. % of boron carbide, relative to the solids content.

The remainder of the boronizing paste according to the invention furthermore contains the usual extenders, such as in particular silicon carbide (SiC), together with water and optionally auxiliaries.

The boronizing paste according to the invention preferably contains, relative to the solids content, 8 to 10 wt. % of boron carbide, 5 to 10 wt. % of potassium tetrafluoroborate, 10 to 30 wt. % of calcium fluoride, 1–3 wt. % of calcium carbonate, 0.2–1 wt. % of sodium nitrite, 0.2–1 wt. % of sodium tetraborate and the remainder silicon carbide as extender, together with water and optionally auxiliaries.

A typical composition consists approximately of 10 wt. % of boron carbide, 7 wt. % of potassium tetrafluoroborate, 15 wt. % of calcium fluoride, 1.5 wt. % of calcium carbonate, 0.5 wt. % of sodium nitrite, 0.5 wt. % of sodium tetraborate and the remainder of silicon carbide, relative to the solids content.

DETAILED DESCRIPTION OF INVENTION

The boronizing agent in paste form according to the invention may, for example, be formulated from the corresponding powder mixture by addition of water and optionally subordinate quantities of auxiliaries, such as conventional commercial binders and/or thickeners.

Depending upon the requirement of the particular application, the water content may amount to 25 to 40 wt. %, relative to the total quantity. The paste preferably contains 30 to 35 wt. % and in particular approximately 30 wt. % of water.

Further auxiliaries which may be considered are thickeners and binders as are conventional when formulating pastes. Bentonite is a particularly suitable thickener. This material is used in the boronizing paste in a small quantity, typically of approximately 1 wt. %, relative to the total quantity.

The boronizing paste according to the invention may very advantageously be used for the production of boride layers on metallic workpieces.

Addition of carbonate reduces the porosity of the boride layer and thus increases the durability of the components. The addition of nitrite eliminates the tendency of known boronizing pastes towards corrosive attack of the component. This results in very good surface appearance. Since, in comparison with known compositions, it has proved possible to reduce the content of $KBF_4$ by partially replacing it with the water insoluble $CaF_2$, the boronizing agent according to the invention is substantially less critical with regard to fluoride emissions, especially in relation to the disposal of waste water after washing boronized components and of spent boronizing agent. A reduced $KBF_4$ content is furthermore advantageous when the boronizing agent is used correctly as correspondingly lower gaseous emissions containing fluorine are generated. The addition of carbonate still further reduces these emissions, so increasing the environmental compatibility of the process. The problems of known boronizing pastes with regard to storage stability are overcome by the addition of borate. The borate, together with the added nitrite, also results in substantially easier cleaning of the components than with known boronizing pastes.

One particular processing advantage of the boronizing paste according to the invention is that single-phase boride layers containing $Fe_2B$ and having a low pore content may straightforwardly and simply be produced on workpieces made from ferrous materials. This is attributable to the preferable selection of a combination of 1 to 15 wt. % of potassium tetrafluoroborate and 5 to 40 wt. % of calcium fluoride, relative to the quantity of the solids in the boronizing paste, as the activating substance.

In the process according to the invention for the production of preferably single-phase boride layers containing $Fe_2B$ and having a low pore content on workpieces made from ferrous materials, the surface of the workpieces is covered with the boronizing paste and treatment is then performed at temperatures of between 800 and 1100° C. until a boride layer of the desired thickness has formed. To this end, the surface of the parts is brushed with the boronizing agent paste. This is particularly advantageous in the event that an only partially boronized surface is desired. The boronizing agent may alternatively also be applied by dipping the parts in the paste or by spraying on the paste.

Boronizing preferably proceeds at temperatures of between 850 and 980° C. over a period of 20 minutes to 2 hours. In this manner, single-phase $Fe_2B$ layers of a thickness of 30 to 150 $\mu$m may be obtained.

EXAMPLE 1

Components made from the material 42CrMo4 were boronized for 45 minutes at 930° C. under protective gas using a boronizing paste of the following composition according to the invention:

30% water; 7.5% $B_4C$; 5% $KBF_4$; 10% $CaF_2$; 45% SiC; 1% $CaCO_3$; 0.3% $NaNO_2$; 0.4% borax; 0.8% bentonite (thickener).

After the heat treatment, the boronizing agent could be removed simply with water without leaving any residues and the components exhibited neither signs of corrosive attack nor stains. The boride layer was FeB free, had a low pore content and a thickness of approx. 50 $\mu$m. Even after extended storage at elevated temperature, the paste exhibited no change in processing characteristics. The pH value was approx. 7.5.

EXAMPLE 2: (Comparative Example)

Components made from the material 42CrMo4 were boronized for 45 minutes at 930° C. under protective gas using a boronizing paste of the following conventional composition:

30% water; 7.5% $B_4C$; 9.2% $KBF_4$; 52.5% SiC; 0.8% bentonite (thickener).

After the heat treatment, the boronizing agent could not be removed completely without leaving residues; adequate cleaning of the components was achieved only after brushing or jet cleaning. The components exhibited slight signs of corrosive attack and severe staining. The boride layer was of a thickness of approx. 50 $\mu$m, but was of two phases; FeB needles reached down to a depth of 14 $\mu$m. In comparison with Example 1, a thicker pore fringe was observed. After extended storage at elevated temperature, the viscosity of the paste had fallen and relatively severe sedimentation of the solids had occurred. The pH value of the paste was approx. 4.

EXAMPLE 3

Components made from the material Cf52 were boronized for 60 minutes at 940° C. under protective gas using a boronizing paste of the following composition according to the invention:

30% water; 7.5% $B_4C$; 5% $KBF_4$; 10% $CaF_2$; 45% SiC; 1% $CaCO_3$; 0.3% $NaNO_2$; 0.4% borax; 0.8% bentonite.

After the heat treatment, the boronizing agent could be removed simply with water without leaving any residues and the components exhibited neither signs of corrosive attack nor stains. The boride layer was FeB free, had a low pore content and a thickness of approx. 70 $\mu$m.

EXAMPLE 4

Components made from the material C 60 were boronized for 120 minutes at 950° C. under protective gas using a boronizing paste of the following composition according to the invention:

30% water; 7.5% $B_4C$; 5% $KBF_4$; 9% $CaF_2$; 45% SiC; 1% $CaCO_3$; 1% $LI_2CO_3$; 0.3% $NaNO_2$; 0.4% borax; 0.8% bentonite.

After the heat treatment, the boronizing agent could be removed simply with water without leaving any residues; the component exhibited neither signs of corrosive attack nor stains. The boride layer was FeB free, had a low pore content and a thickness of approx. 140 $\mu$m.

EXAMPLE 5

Components made from the material 42CrMo4 were boronized for 45 minutes at 930° C. under protective gas using a boronizing paste of the following composition according to the invention:

30% water; 7.5% $B_4C$; 8% $KBF_4$; 50% SiC; 3% $CaCO_3$; 0.3% $NaNO_2$; 0.4% borax; 0.8% bentonite.

After the heat treatment, the boronizing agent could be removed simply with water without leaving any residues and the components exhibited neither signs of corrosive attack nor stains. The boride layer was FeB free, had a low pore content and a thickness of approx. 52 $\mu$m. Emissions of fluorine compounds were approx. 25% greater than those from Example 1.

EXAMPLE 6: (Comparative Example)

Components made from the material 42CrMo4 were boronized for 45 minutes at 930° C. under protective gas using a boronizing paste containing neither calcium carbonate nor calcium fluoride and of the following composition:

30% water; 7.5% $B_4C$; 9% $KBF_4$; 52% SiC; 0.3% $NaNO_3$; 0.4% borax; 0.8% bentonite.

After the heat treatment, the boronizing agent could be removed simply with water without leaving any residues and the components exhibited neither signs of corrosive attack nor stains. The boride layer, of a thickness of approx. 50 $\mu$m, was two-phase and FeB needles reached down to a depth of 10 $\mu$m. The layer more highly porous than in Example 5. Emissions of fluorine compounds were approx. 40% greater than those from Example 1.

Further variations and modifications of the foregoing invention will be apparent to those skilled in the art and are intended to be encompassed by the claims appended hereto.

German priority application 199 04 629.8 is relied on and incorporated herein by reference.

We claim:

1. A boronizing agent in the form of a paste for the production of boride layers on metallic workpieces, comprising a boron-releasing substance, an activating substance and the remainder of inert, refractory extender together with water and an auxiliary required for paste formulation, and containing as an additive:

(a) calcium carbonate and/or lithium carbonate;

(b) at least one compound selected from the group consisting of an alkali metal nitrite and an alkaline earth metal nitrite; and (c) at least one compound selected from the group consisting of a water soluble alkali metal borate and an alkaline earth metal borate.

2. The boronizing agent according to claim 1, which contains, relative to the solids content, 0.1–5 wt. % of calcium carbonate and/or lithium carbonate, 0.1–2 wt. % of a compound according to (b) and 0.1–2 wt. % of a compound according to (c).

3. The boronizing agent according to claim 1 which contains, relative to the solids content, 1–3 wt. % of calcium carbonate and/or lithium carbonate, 0.2–1 wt. % of a compound according to (b) and 0.2–1 wt. % of a compound according to (c).

4. The boronizing agent according to claim 1 which contains calcium carbonate and/or lithium carbonate according to (a), an alkali metal nitrite, as a compound according to (b), and an alkali metal borate, as a compound according to (c).

5. The boronizing agent according to claim 2 which contains calcium carbonate and/or lithium carbonate according to (a), an alkali metal nitrite, as a compound according to (b), and an alkali metal borate, as a compound according to (c).

6. The boronizing agent according to claim 3 which contains calcium carbonate and/or lithium carbonate according to (a), an alkali metal nitrite, as a compound according to (b), and an alkali metal borate, as a compound according to (c).

7. The boronizing agent according to claim 1 which contains boron carbide as the boron-releasing substance, potassium tetrafluoroborate as the activating substance, and silicon carbide as the extender.

8. The boronizing agent according to claim 2 which contains boron carbide as the boron-releasing substance, potassium tetrafluoroborate as the activating substance and silicon carbide as the extender.

9. The boronizing agent according to claim 3 which contains boron carbide as the boron-releasing substance, potassium tetrafluoroborate as the activating substance and silicon carbide as the extender.

10. The boronizing agent according to claim 1 which contains a combination of potassium tetrafluoroborate and calcium fluoride as the activating substance.

11. The boronizing agent according to claim 1 which contains 1 to 15 wt. % of boron carbide as the boron-releasing substance and a combination of 1 to 15 wt. % of potassium tetrafluoroborate and 5 to 40 wt. % of calcium fluoride, in each case relative to the solids content, as the activating substance.

12. The boronizing agent according to claim 1 which contains, relative to the solids content, 8 to 10 wt. % of boron carbide, 5 to 10 wt. % of potassium tetrafluoroborate, 10 to 30 wt. % of calcium fluoride, 1–3 wt. % of calcium carbonate, 0.2–1 wt. % of sodium nitrite, 0.2–1 wt. % of sodium tetraborate and the remainder silicon carbide as extender, together with water and optionally auxiliaries.

13. The boronizing agent according to claim 1 which contains relative to the solids content, 10 wt. % of boron carbide, 7 wt. % of potassium tetrafluoroborate, 14 wt. % of calcium fluoride, 1.5 wt. % of calcium carbonate, 1 wt. % of lithium carbonate, 0.5 wt. % of sodium nitrite, 0.5 wt. % of sodium tetraborate and the remainder of silicon carbide.

14. The boronizing agent according to claim 4 wherein (a) is calcium carbonate, (b) is sodium nitrite and (c) is sodium tetraborate.

15. A process for the production of boride layers containing $Fe_2B$ and having a low pore content on workpieces made from ferrous materials, comprising covering a surface of a workpiece with the boronizing paste according to claim 1 and heating said surface at temperatures of between 800 and 1100° C. until a boride layer of the desired thickness has formed.

16. The process according to claim 15 comprising heating at temperatures of between 850 and 950° C. over a period from 20 minutes to 2 hours in order to produce $Fe_2B$ layers of a thickness of 30 to 150 $\mu$m.

* * * * *

UNITED STATES PATENT AND TRADEMARK OFFICE

CERTIFICATE OF CORRECTION

PATENT NO. : 6,503,344 B2
DATED : January 7, 2003
INVENTOR(S) : Ulrich Baudis et al.

It is certified that error appears in the above-identified patent and that said Letters Patent is hereby corrected as shown below:

Column 7,
Line 5, after “and” (first occurrence) insert -- optionally --; after “auxiliary” delete -- required --.

Signed and Sealed this

Thirteenth Day of January, 2004

JON W. DUDAS
*Acting Director of the United States Patent and Trademark Office*